US009126795B2

(12) United States Patent
Saitoh et al.

(10) Patent No.: US 9,126,795 B2
(45) Date of Patent: Sep. 8, 2015

(54) IMAGE FORMING APPARATUS

(71) Applicants: Naoki Saitoh, Kanagawa (JP); Tomomi Katoh, Kanagawa (JP); Hiroshi Noda, Kanagawa (JP); Yuta Moriwaki, Kanagawa (JP)

(72) Inventors: Naoki Saitoh, Kanagawa (JP); Tomomi Katoh, Kanagawa (JP); Hiroshi Noda, Kanagawa (JP); Yuta Moriwaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/202,391

(22) Filed: Mar. 10, 2014

(65) Prior Publication Data

US 2014/0265106 A1 Sep. 18, 2014

(30) Foreign Application Priority Data

Mar. 15, 2013 (JP) ..... 2013-052702

(51) Int. Cl.

| | |
|---|---|
| ***B65H 29/00*** | (2006.01) |
| ***B65H 43/00*** | (2006.01) |
| ***B65H 29/12*** | (2006.01) |
| ***B65H 29/14*** | (2006.01) |
| ***B65H 29/66*** | (2006.01) |
| ***B65H 85/00*** | (2006.01) |

(Continued)

(52) U.S. Cl.

CPC ..... *B65H 43/00* (2013.01); *B65H 29/125* (2013.01); *B65H 29/14* (2013.01); *B65H 29/6609* (2013.01); *B65H 85/00* (2013.01); *B65H 39/10* (2013.01); *B65H 2301/151* (2013.01); *B65H 2301/1511* (2013.01); *B65H 2301/4493* (2013.01); *B65H 2511/51* (2013.01); *B65H 2511/514* (2013.01); *B65H 2513/512* (2013.01); *B65H 2513/514* (2013.01); *B65H 2701/186* (2013.01); *B65H 2801/06* (2013.01); *G03G 15/6576* (2013.01)

(58) Field of Classification Search

CPC ..... B65H 39/06; B65H 2701/162; B65H 2701/1862; B65H 29/68; B65H 2301/151; B65H 2301/1511; B65H 2301/517; B65H 2701/18; B65H 2301/5176

USPC ..... 271/306, 278, 207

See application file for complete search history.

(56) References Cited

U.S. PATENT DOCUMENTS 6,491,492 B1 * 12/2002 Cook ..... 414/789.9
2010/0127447 A1 * 5/2010 Hammen ..... 271/3.14

(Continued)

FOREIGN PATENT DOCUMENTS

JP 2012-140245 7/2012

OTHER PUBLICATIONS

U.S. Appl. No. 14/011,331, filed Aug. 27, 2013.

(Continued)

*Primary Examiner* — Howard Sanders
(74) *Attorney, Agent, or Firm* — Cooper & Dunham LLP

(57) ABSTRACT

An image forming apparatus includes an output unit, a pair of output rotary bodies, and a controller. A sheet having an image formed thereon is discharged to the output unit. When plural sheets are sequentially discharged to the output unit, the controller controls overlapping output operation to, with a trailing end portion of a preceding sheet of the plural sheets being held by the pair of output rotary bodies, feed a subsequent sheet of the sheets to between the pair of output rotary bodies to overlap a leading end portion of the subsequent sheet with the trailing end portion of the preceding sheet. With the leading end portion of the subsequent sheet overlapped with the trailing end portion of the preceding sheet, the controller controls the pair of output rotary bodies to rotate to discharge the preceding sheet to the output unit.

2 Claims, 6 Drawing Sheets

(51) Int. Cl.
*B65H 39/10* (2006.01)
*G03G 15/00* (2006.01)

(56) References Cited

U.S. PATENT DOCUMENTS

2012/0147112 A1 6/2012 Tanaka et al.
2013/0162718 A1 6/2013 Noda
2013/0194346 A1 8/2013 Moriwaki
2014/0015896 A1 1/2014 Katoh

OTHER PUBLICATIONS

U.S. Appl. No. 14/026,000, filed Sep. 13, 2013.

* cited by examiner

IMAGE FORMING APPARATUS

CROSS-REFERENCE TO RELATED APPLICATIONS

This patent application is based on and claims priority pursuant to 35 U.S.C. §119 to Japanese Patent Application No. 2013-052702, filed on Mar. 15, 2013, in the Japan Patent Office, the entire disclosure of which is hereby incorporated by reference herein.

BACKGROUND

1. Technical Field

Embodiments of this disclosure relate to an image forming apparatus.

2. Description of the Related Art

Image forming apparatuses are used as printers, facsimile machines, copiers, plotters, or multi-functional devices having at least one of the foregoing capabilities. As one type of image forming apparatus employing a liquid-ejection recording method, inkjet recording apparatuses are known that use a recording head (liquid ejection head or liquid-droplet ejection head) for ejecting droplets of ink or other liquid.

In such a liquid-ejection-type image forming apparatus, a discharged sheet may curl due to drying of liquid. When the discharged sheet curls on a discharge tray, the curled sheet conflict a subsequent sheet, thus reducing stacking performance.

Hence, for example, JP-2012-140245-A proposes an output tray to receive a leading end side and a trailing end side of a discharged sheet with different surfaces. The sheet is discharged with the leading end side tilted, and the trailing end side is pressed against the corresponding surface of the output tray by its weight. As a result, the sheet is bent to suppress curling of the trailing end side of the sheet, thus enhancing stacking performance.

Even in such a configuration, depending on the type of ink used for image formation, printing speed (print per minute: PPM), or print coverage (image area per sheet), curling of a sheet may not be suppressed, thus hampering enhancement of stacking performance.

BRIEF SUMMARY

In at least one embodiment of this disclosure, there is provided an image forming apparatus including an output unit, a pair of output rotary bodies, and a controller. A sheet having an image formed thereon is discharged to the output unit. The pair of output rotary bodies discharges the sheet to the output unit. The controller controls the pair of output rotary bodies to feed the sheet. When plural sheets are sequentially discharged to the output unit, the controller controls overlapping output operation to, with a trailing end portion of a preceding sheet of the plural sheets being held by the pair of output rotary bodies, feed a subsequent sheet of the plural sheets to between the pair of output rotary bodies to overlap a leading end portion of the subsequent sheet with the trailing end portion of the preceding sheet. With the leading end portion of the subsequent sheet overlapped with the trailing end portion of the preceding sheet, the controller controls the pair of output rotary bodies to rotate to discharge the preceding sheet to the output unit.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
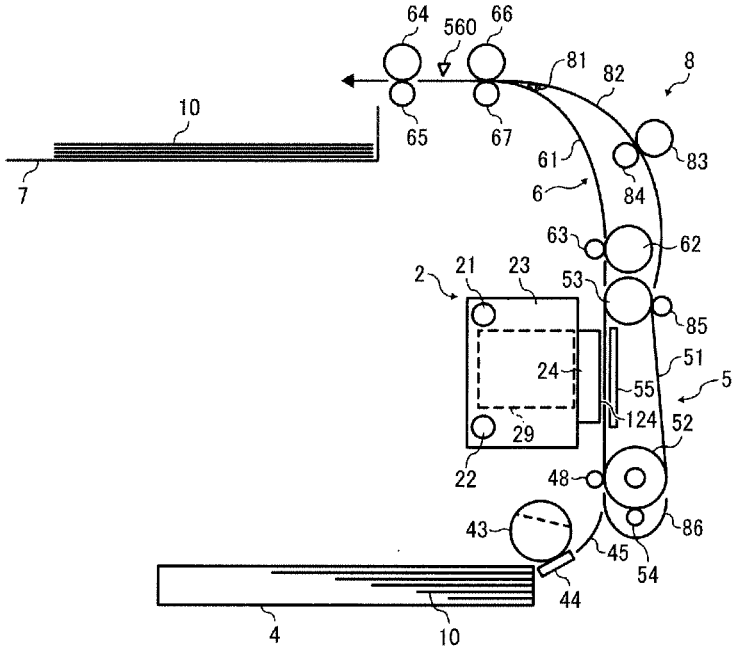
FIG. 1 is a side view of a mechanical section of an image forming apparatus according to an embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

In embodiments described below, a liquid-ejection-type image forming apparatus is described as an example of an image forming apparatus. However, the image forming apparatus may be an electrophotographic image forming apparatus.

Although the exemplary embodiments are described with technical limitations with reference to the attached drawings, such description is not intended to limit the scope of the disclosure and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an embodiment of this disclosure is described with reference to FIGS. 1 and 2.

Figure 2:
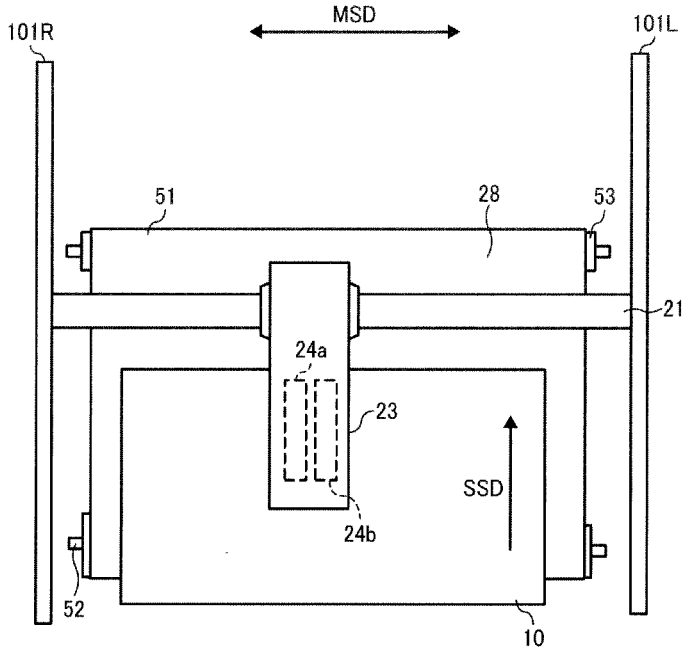
FIG. 2 is a back view of the mechanical section illustrated in FIG. 1.

FIG. 1 is a side view of a mechanical section of an image forming apparatus according to an embodiment of this disclosure. FIG. 2 is a back view of the mechanical section illustrated in FIG. 1.

In FIG. 1, the image forming apparatus is a serial-type image forming apparatus. The image forming apparatus includes an image forming device 2 serving as an image forming unit and a conveyance assembly 5 serving as a conveyance unit within an apparatus body. At a lower side of the apparatus body, the image forming apparatus further includes a feed tray 4 (or a feed cassette) serving as a feed unit to stack sheets 10 serving as recording media.

When a sheet 10 is fed from the feed tray 4, the conveyance assembly 5 roc sheet 10. While the sheet 10 is intermittently conveyed in a vertical direction by the conveyance assembly 5, the image forming device 2 ejects liquid droplets in a horizontal direction to record a desired image on the sheet 10. The sheet 10 having the desired image formed thereon is further conveyed upward through an output conveyance unit 6, and discharged onto an output tray 7 serving as an output unit.

For duplex printing (double-face printing), after printing on one face (front face) ends, a reverse unit 8 receives the sheet 10 from the output conveyance unit 6. While conveying the sheet 10 in the opposite direction (downward direction), the conveyance assembly 5 turns around and feeds the sheet 10 toward the image forming device 2 again so that the image forming device 2 can print on the other face (back face) of the sheet 10. After printing on the other face (back face) ends, the output conveyance unit 6 discharges the sheet 10 to the output tray 7.

Here, for the image forming device 2, a carriage 23 mounting recording heads 24 is movably held by a main guide member 21 and a sub guide member 22 extending between a left side plate 101L and a right side plate 101R. A main scanning motor of a carriage moving assembly moves the carriage 23 for scanning in a main scanning direction indicated by arrow MSD in FIG. 2, via a timing belt looped between a driving pulley and a driven pulley.

The carriage 23 mounts, for example, recording heads 24*a* and 24*b* (referred to as "recording heads 24" unless distinguished) serving as liquid ejection heads to eject ink droplets of different colors, e.g., yellow (Y), magenta (M), cyan (C), and black (K). The recording heads 24*a* and 24*b* having nozzle rows are mounted on the carriage 23 so that multiple nozzles forming each of the nozzle rows are arrayed in line in a sub scanning direction, which indicated by arrow SSD in FIG. 2, perpendicular to the main scanning direction MSD and ink droplets are ejected from the nozzles in the horizontal direction. In other words, the image forming apparatus employs a horizontal ejection method in which a nozzle face having multiple nozzles in each recording head 24 is oriented in the vertical direction to eject liquid droplets in the horizontal direction.

Each recording head 24 has, for example, two nozzle rows, each of which multiple nozzles are arrayed in line to eject liquid droplets. For example, one of the nozzle rows of the recording head 24*a* ejects droplets of yellow (Y), and the other ejects droplets of magenta (M). For example, one of the nozzle rows of the recording head 24*b* ejects droplets of black (B), and the other ejects droplets of cyan (C).

The carriage 23 mounts head tanks 29 to supply the respective color inks to the corresponding nozzle rows of the recording heads 24. Ink cartridges (main tanks) for the color inks are removably mounted to the apparatus body, and the color inks are supplied from the ink cartridges to the head tanks 29.

The sheets 10 in the feed tray 4 are separated by a sheet feed roller (half-moon-shaped roller) 43 and a separation pad 44 and fed sheet by sheet into the apparatus body. The sheet 10 is sent along a conveyance guide member 45 to between a conveyance belt 51 and a press roller 48, and attached to and conveyed by the conveyance belt 51.

The conveyance assembly 5 includes, e.g., the conveyance belt 51, a conveyance roller 53, a driven roller 53, and a charging roller 54, and a platen member 55. The conveyance belt 51 has an endless shape and is looped around and between the conveyance roller 52, serving as a driving roller, and the driven roller 53. The charging roller 54 charges the conveyance belt 51. The platen member 55 is disposed opposing the image forming device 2 to maintain flatness of the conveyance belt 51. The conveyance roller 52 is rotated by a sub-scanning motor via a timing belt and a timing pulley. By rotation of the conveyance roller 52, the conveyance belt 51 is moved for circulation in a belt conveyance direction (also referred to as sub-scanning direction SSD or sheet conveyance direction).

The output conveyance unit 6 includes an output guide member 61, an output conveyance roller 62, a spur wheel 63, an output roller 64, a spur wheel 65, an output conveyance roller 66, and a spur wheel 67. The output conveyance unit 6 discharges the sheet 10 having an image formed, from between the output roller 64 and the spur wheel 65 onto the output tray 7 in a face-down manner. In other words, in this embodiment, the output roller 64 and the spur wheel 65 form a pair of output rotary bodies. The output conveyance roller 66 and the spur wheel 67 form a pair of conveyance rotary bodies closest to the pair of output rotary bodies and upstream from the pair of output rotary bodies in the sheet conveyance direction.

The reverse unit 8 has a switching tab 81 to switch a transport route of the sheet between an output passage and a reverse passage. Using the switching tab 81, the reverse unit 8 sends the sheet 10, which is partially discharged to the output tray 7, back to between the conveyance belt 51 and the regulation roller 48 while turning the sheet 10 upside down in a switchback manner. The reverse unit 8 also has a reverse guide member 82, a reverse roller 83, a spur roller 84, and an auxiliary conveyance roller 85. The spur roller 84 serves as a reverse roller. The auxiliary conveyance roller 85 is disposed opposing the driven roller 53. The reverse unit 8 also includes an opposite conveyance portion of the conveyance belt 51 and a bypass guide member 86 to guide the sheet 10 separated from the opposite conveyance portion of the conveyance belt 51 to between the conveyance belt 51 and the regulation roller 48 while bypassing the charging roller 54.

The opposite conveyance portion of the conveyance belt 51 means a portion of the conveyance belt 51 to convey the sheet 10 in the opposite direction to the direction in which the sheet 10 is conveyed when an image is formed on the sheet 10. A normal conveyance portion means a portion of the conveyance belt 51 to convey the sheet 10 while opposing the recording heads 24.

In the image forming apparatus having the above-described configuration, the sheet 10 is separately fed from the feed tray 4, is electrostatically attached onto the conveyance belt 51 charged by the charging roller 54, and conveyed in the vertical direction by the circulation of the conveyance belt 51. By driving the recording heads 24 in accordance with image signals while moving the carriage 23, ink droplets are ejected onto the sheet 10 stopped to form one line of a desired image. The sheet 10 is fed by a certain distance to prepare for recording another line of the image. After the recording of the image is completed, the sheet 10 is discharged to the output tray 7.

In duplex printing, an image is printed on a first face of the sheet 10 as described above. When a rear edge of the sheet 10 passes a branching part (switching tab 81) of the reverse unit 8, the output roller 64 is rotated in reverse to switch the sheet 10 back. Further, the sheet 10 is guided toward the reverse guide member 82, conveyed to between the reverse roller 83 and the spur roller 84, and sent into between the opposite conveyance portion of the conveyance belt 51 and the auxiliary conveyance roller 85.

As a result, the sheet 10 is attached onto the conveyance belt 51 by static electricity, conveyed by the circulation of the conveyance belt 51, separated from the conveyance belt 51 at the conveyance roller 52, guided by the bypass guide member 86 (via a bypass passage), sent into between the normal conveyance portion of the conveyance belt 51 and the press roller 48, and attached onto the conveyance belt 51. Then, with the sheet 10 attached on the conveyance belt 51, the sheet 10 is conveyed to an image formation area in which image formation. After a second face of the sheet 10 is printed at the image formation area, the sheet 10 is output to the output tray 7.

Next, an outline of a controller of an image forming apparatus according to an embodiment is described with reference to FIG. 3.

Figure 3:
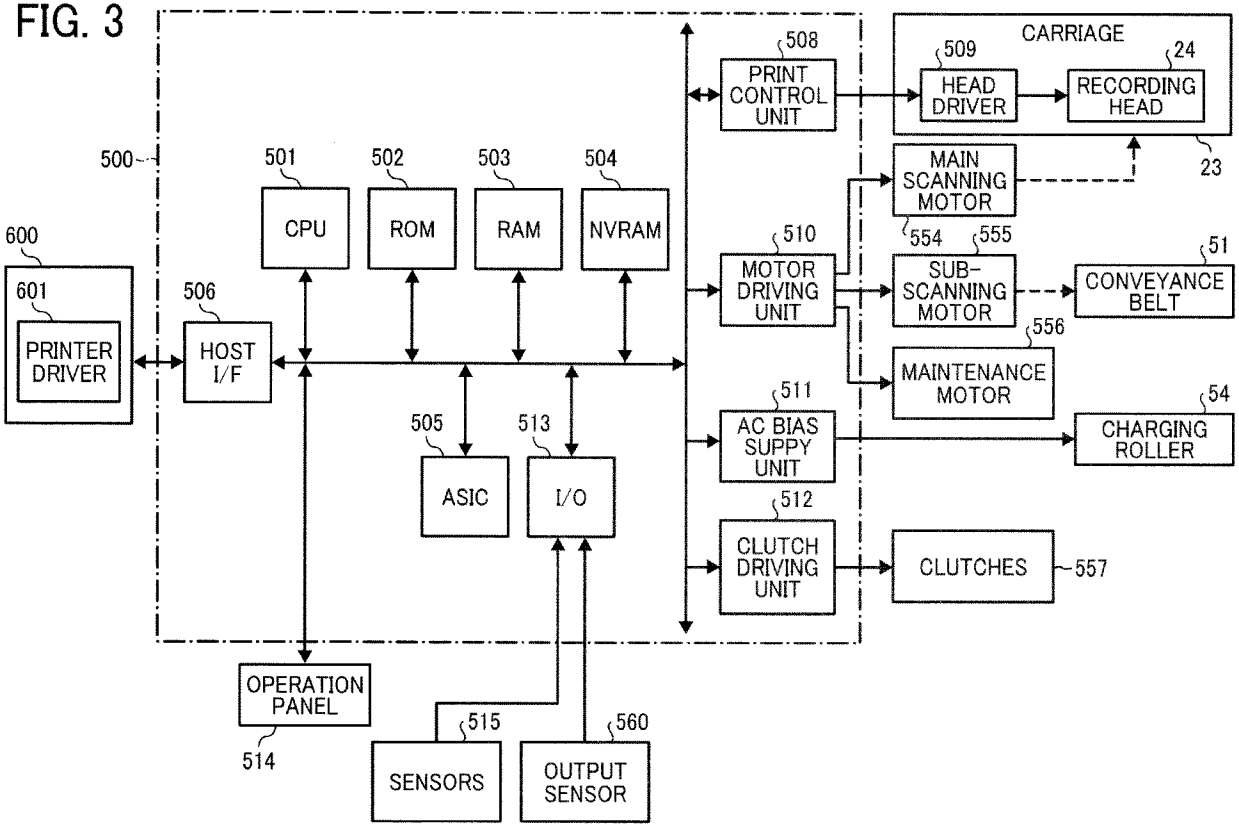
FIG. 3 is a block diagram of a controller of the image forming apparatus according to an embodiment of this disclosure.

FIG. 3 is a block diagram of a controller 500 of the image forming apparatus according to an embodiment of this disclosure.

The controller 500 includes a central processing unit (CPU) 501, a read-only memory (ROM) 502, a random access memory (RAM) 503, a rewritable non-volatile memory (NVRAM) 504, and an application specific integrated circuit (ASIC) 505. The CPU 501 controls the entire image forming apparatus. The ROM 502 stores fixed data, such as programs executed by the CPU 501. The RAM 503 temporarily stores image data and other data. The NVRAM 504 retains data even while the apparatus is powered off. The ASIC 505 processes signals for image data, performs image processing, e.g., sorting, or processes input and output signals for controlling the entire image forming apparatus.

The controller 500 also includes a print control unit 508, a head driver (driver IC) 509, a motor driving unit 510, an alternating current (AC) bias supply unit 511, and a clutch driving unit 512. The print control unit 508 includes a data transmitter and a driving signal generator to drive and control the recording heads 24 in accordance with print data. The head driver 509 drives the recording heads 24 mounted on the carriage 23. The motor driving unit 510 drives a main scanning motor 554 to move the carriage 23, a sub-scanning motor 555 to circulate the conveyance belt 51, and a maintenance motor 556 to drive a maintenance assembly. The AC bias supply unit 511 supplies AC bias to the charging roller 54. The clutch driving unit 512 drives clutches 557.

The controller 500 is connected to an operation panel 514 (e.g., control panel) to input and display information necessary to the image forming apparatus.

The controller 500 includes a host interface (I/F) 506 to transmit and receive data and signals to and from a host 600, such as an information processing device (e.g., personal computer), an image reading device, or an image pick-up device via a cable or network.

The CPU 501 of the controller 500 reads and analyzes print data stored in a reception buffer of the host I/F 506, performs desired image processing, data sorting, or other processing in the ASIC 505, and transmits image data from the print control unit 508 to the head driver 509. It is to be noted that dot-pattern data for image output may be created by either a printer driver 601 of the host 600 or the controller 500.

The print control unit 508 transmits the above-described image data as serial data and outputs to the head driver 509, for example, transfer clock signals, latch signals, and control signals required for the transmission of print data and determination of the transmission. The print control unit 508 further includes the driving signal generator including, e.g., a digital/analog (D/A) converter to convert pattern data of driving pulses stored in the ROM 502 from digital to analog, a voltage amplifier, and a current amplifier. From the driving signal generator, a driving signal formed of one or more driving pulses is output to the head driver 509.

In accordance with serially-input image data corresponding to one line of a desired image recorded by the recording heads 24, the head driver 509 selects driving pulses constituting a driving waveform transmitted from the print control unit 508 and applies the selected driving pulses to pressure generators of the recording heads 24, thus driving the recording heads 24. At this time, by selecting a portion or all of the driving pulses constituting the driving signal or selecting all or a portion of waveform elements forming the driving pulses, liquid droplets of different liquid amounts, such as large-size droplets, medium-size droplets, and small-size droplets, can be selectively ejected to form different sizes of dots.

An input/output (I/O) unit 513 acquires information from sensors 515 mounted in the image forming apparatus, extracts information for controlling printing operation, and controls the print control unit 508, the motor driving unit 510, and the AC bias supply unit 511 based on the extracted information. The sensors 515 include, for example, an optical sensor to detect the position of a sheet, a thermistor to monitor temperature and/or humidity in the apparatus, a voltage sensor to monitor the voltage of the conveyance belt charged, and an interlock switch to detect the opening and closing of a cover. The I/O unit 513 is capable of processing information from such various types of sensors.

As illustrated in FIG. 1, between the output roller 64 and the spur wheel 65 and between the output conveyance roller 66 and the spur wheel 67, an output sensor 560 serving as a sheet detector is disposed to detect the rear edge of the sheet 10. A detection signal of the output sensor 560 is input to the I/O unit 513. Based on a detection result of the output sensor 560, the controller 500 controls the start and stop of rotation of the output roller 64.

In such a case, in this embodiment, the driving force of the sub-scanning motor 555 is transmitted to, e.g., the output roller 64 and the output roller 64 via clutches of the clutches 557. When the output roller 64 and the spur wheel 65 hold a sheet 10, the controller 500 controls the clutch driving unit 512 to release a clutch transmitting the driving force to the output roller 64. As a result, the rear edge of the sheet 10 is held between the output roller 64 and the spur wheel 65.

Next, curling of a sheet on the sheet output tray (output unit) is described with reference to FIGS. 4A and 4B.

Figure 4A:
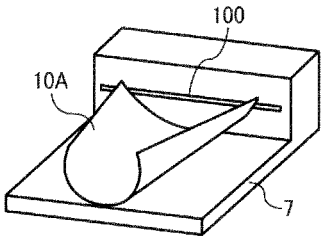
FIGS. 4A and 4B are perspective views of a curled sheet on an output tray (output unit)
Figure 4B:
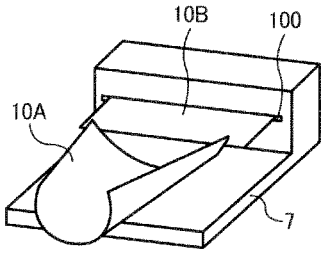

FIGS. 4A and 4B are perspective views of a sheet on the sheet output tray.

If a sheet 10A having an image formed thereon is discharged to and curled on the output tray 7 and a trailing end portion of the sheet 10A rises to be higher than an output port 100 as illustrated in FIG. 4A, a subsequent sheet 10B hits and pushes the sheet 10A as illustrated in FIG. 4B, thus reducing stacking performance of output sheets.

For inkjet recording, for example, when ink penetrates a printing surface (a lower face of the sheet on the output tray) and fibers of the sheet extend, curling is likely to occur.

Figure 5:
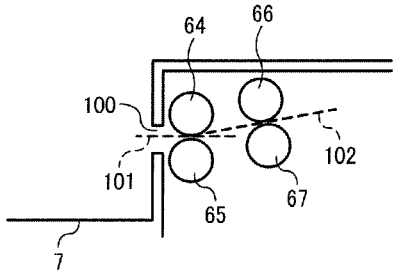
FIG. 5 is a schematic view of relative positions of an output roller and a spur wheel and an output conveyance roller and a spur wheel disposed at an output port area to perform overlapping output operation.

Next, relative positions of a roller and a spur wheel disposed at an output port area to perform overlapping output operation in this embodiment are described with reference to FIG. 5.

The output roller 64 and the spur wheel 65 are disposed upstream from the output port 100 in a sheet conveyance direction. The output roller 64 and the spur wheel 65 are also disposed opposing to each other so that a common tangent line 101 is horizontal.

In addition, the output conveyance roller 66 and the spur wheel 67 are disposed upstream from the output roller 64 and the spur wheel 65 in the sheet conveyance direction. The output conveyance roller 66 and the spur wheel 67 are also disposed opposing to each other so that a common tangent line 102 crosses the common tangent line 101 from an obliquely upward side.

In this embodiment, the spur wheels 65 and 67 are employed. However, for example, driven rollers may be employed instead of the spur wheels.

Next, overlapping output operation in this embodiment is described with reference to FIGS. 6A to 6E.

Figure 6A:
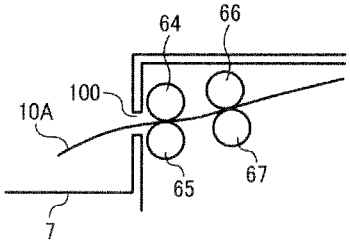
FIGS. 6A to 6E are schematic views of the output roller and the spur wheel and the output conveyance roller and the spur wheel during overlapping output operation.

To perform overlapping output operation, as illustrated in FIG. 6A, the pair of the output conveyance roller 66 and the spur wheel 67 and the pair of the output roller 64 and the spur wheel 65 convey a preceding sheet 10A having an image formed thereon, indicated by a solid line in FIG. 6A, and discharge the preceding sheet 10A from the output port 100 to the output tray 7.

Figure 6B:
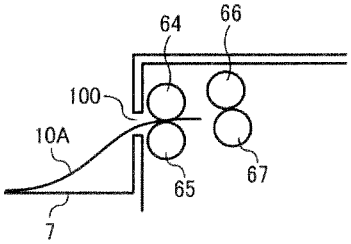

When the output sensor 560 detects a trailing end portion of the sheet 10A, the controller 500 releases transmission of the driving force to the output roller 64 to stop the output roller 64. As a result, as illustrated in FIG. 6B, the trailing end portion of the sheet 10A is held in a state in which the trailing end portion is sandwiched between the output roller 64 and the spur wheel 65.

Figure 6C:
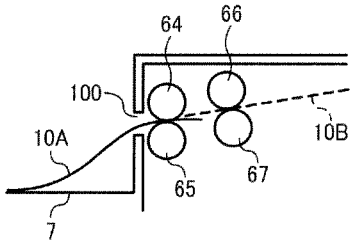

Then, as illustrated in FIG. 6C, when a subsequent sheet 10B indicated by a broken line in FIG. 6C is conveyed, a leading end portion of the sheet 10B overlaps the trailing end of the sheet 10A from above and is sent into between the output roller 64 and the spur wheel 65.

Figure 6D:
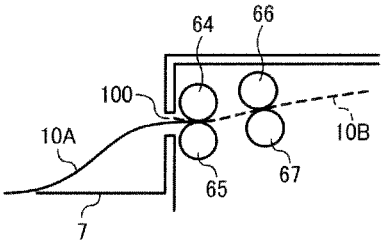

Then, when the driving force transmitted to the output roller 64 to rotate the output roller 64 and the spur wheel 65, as illustrated in FIG. 6D, the trailing end portion of the preceding sheet 10A and the leading end portion of the subsequent sheet 10B are discharged to the output tray 7 with the trailing end portion of the preceding sheet 10A and the leading end portion of the subsequent sheet 10B overlapped with each other.

Figure 6E:
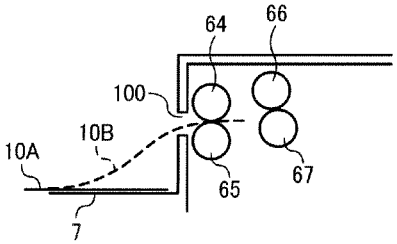

As illustrated in FIG. 6E, when the preceding sheet 10A is discharged onto the output tray 7 and the trailing end portion of the subsequent sheet 10B is detected, the driving of the output roller 64 is stopped. As a result, the trailing end portion of the subsequent sheet 10B is held by the output roller 64 and the spur wheel 65 in a state in which the trailing end portions of is sandwiched between the output roller 64 and the spur wheel 65.

By repeating similar operation, a preceding sheet and a leading end portion of a subsequent sheet are discharged in turn onto the output tray 7 with a trailing end portion of the preceding sheet and a leading end portion of the subsequent sheet overlapped with each other.

As described above, when plural sheets are sequentially output, a preceding sheet and a subsequent sheet are discharged with a leading end of the subsequent sheet overlapping a trailing end portion of the preceding sheet. Such a configuration prevents a failure as described with reference to FIGS. 4A and 4B in which the trailing end portion of the preceding sheet rising up due to curling pushes the subsequent sheet.

For such a configuration, the subsequent sheet is held in a state in which the subsequent sheet covers an area above the trailing end portion of the preceding sheet, thus suppressing curling of the preceding sheet.

As described above, when plural sheets are sequentially output to the output unit, with a trailing end portion of a preceding sheet being held by the pair of output rotary bodies, a subsequent sheet is sent into between the pair of output rotary bodies. With the leading end portion of the subsequent sheet overlapping the trailing end portion of the preceding sheet, the pair of output rotary bodies are driven for rotation to discharge the preceding sheet to the output unit. Controlling such overlapping output operation prevents the subsequent sheet from pushing the preceding sheet, thus enhancing stacking performance of output sheets.

Figure 7:
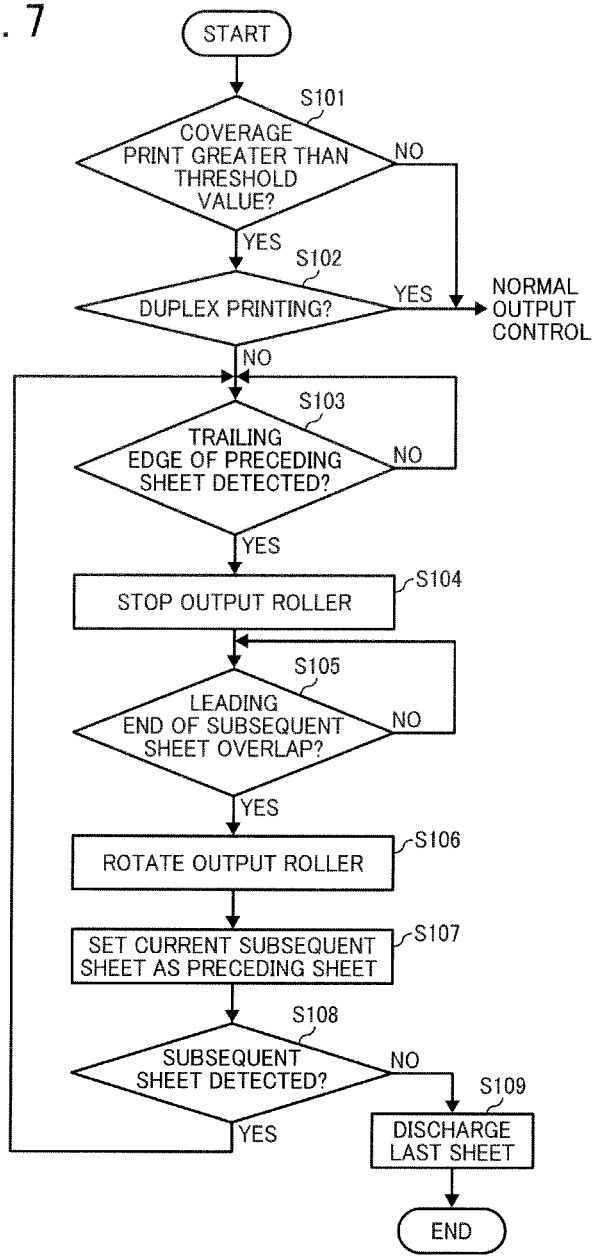
FIG. 7 is a flowchart of an example of overlapping output operation performed by the controller according to an embodiment of this disclosure.

Next, an example of control of overlapping output operation performed by the controller 500 according to an embodiment of this disclosure is described with reference to FIG. 7.

At S101, based on image data, the controller 500 determines whether or not a print coverage of a sheet is a predetermined threshold value or greater. The term "print coverage" used herein represents a percentage of an image formed area (ink adhering area) in a total area of a sheet.

When the print coverage of the sheet is less than the threshold value (NO at S101), the controller 500 determines that the sheet is not tightly curled, and shifts to normal output control to discharge the sheet without overlapping the sheet with a subsequent sheet.

By contrast, when the print coverage of the sheet is the threshold value or greater (YES at S101), at S102 the controller 500 determines whether or not current printing is duplex printing. When current printing is duplex printing (YES at S102), similarly, the controller 500 determines that the sheet is not tightly curled, and shifts to normal output control.

By contrast, when the print coverage of the sheet is the threshold value or greater (YES at S101) and current printing is not duplex printing (NO at S102), at S103 the controller 500 determines whether or not the output sensor 560 detects a trailing end portion of the (preceding) sheet. When the output sensor 560 detects the trailing end portion of the (preceding) sheet (YES at S103), at S104 the controller 500 stops rotation of the output roller 64 to perform the overlapping output operation.

The controller 500 controls the output roller 64 to wait until a leading end portion of the subsequent sheet overlaps the trailing end portion of the preceding sheet. When the leading end portion of the subsequent sheet overlaps the trailing end portion of the preceding sheet (YES at S105), at S106 the controller 500 controls the output roller 64 to rotate to discharge the preceding sheet to the output tray 7.

At S107, the controller 500 sets the current subsequent sheet as a preceding sheet, and at S108 determines whether or not a further subsequent sheet is detected.

When the further subsequent sheet is detected (YES at S108), the process returns to step S103 to determine whether or not the trailing end portion of the preceding sheet is detected, and repeat the subsequent steps.

By contrast, when the further subsequent sheet is not detected (NO at S108), the controller 500 determines that the current subsequent sheet is the last sheet, and at S109 discharges the current subsequent sheet without stopping the output roller 64 to hold a state in which the trailing end portion of the current subsequent sheet is sandwiched with the output roller 64 and the spur wheel 65.

When print jobs are sequentially performed or when a subsequent print job is started immediately after the end of a preceding print job so that a last page of the preceding print job and a first page of the subsequent print job are continuously fed, the controller 500 can process the last page of the preceding print job as being not the last page.

In other words, when print jobs are sequentially performed, the controller 500 controls the output roller 64 to discharge only a last page of a last print job without holding a trailing end portion of the last page of the last print job.

When print jobs are sequentially performed, such a configuration can prevent a leading page of a subsequent print job, which is discharged later, from pushing a last page of a preceding print job, which is discharged earlier, between the print jobs.

In the above-described embodiment, the image forming apparatus is described as a horizontal ejection type image forming apparatus to horizontally eject droplets. However, the ejecting direction is not limited to the horizontal direction but droplets may be ejected, for example, vertically upward or downward, or obliquely upward or downward.

In addition, the conveyance unit is not limited to the above-described conveyance belt. For example, a sheet may be conveyed only by conveyance rollers.

The output roller may be arranged to detachably contact the spur wheel or the driven roller. In such a case, when the output roller does not hold a sheet with the spur wheel or the driven roller, the spur wheel or the driven roller can be detached from the output roller to fall the sheet onto the output tray by its weight.

In addition, immediately after a sheet held between the output roller and the spur wheel is detached from the holding portion, the controller can temporarily increase the conveyance speed. Such a configuration allows a subsequently discharged sheet to be more reliably stacked on a precedently discharged sheet.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an output unit to which a sheet having an image formed thereon is discharged;

a pair of output rotary bodies to discharge the sheet to the output unit; and a controller to control the pair of output rotary bodies to feed the sheet, wherein, when plural sheets are sequentially discharged to the output unit, the controller controls overlapping output operation to, with a trailing end portion of a preceding sheet of the plural sheets being held by the pair of output rotary bodies, feed a subsequent sheet of the plural sheets to between the pair of output rotary bodies to overlap a leading end portion of the subsequent sheet with the trailing end portion of the preceding sheet, and with the leading end portion of the subsequent sheet overlapped with the trailing end portion of the preceding sheet, the controller controls the pair of output rotary bodies to rotate to discharge the preceding sheet to the output unit, wherein, at least one of when the sheet is a last sheet of a print job having no subsequent print job, after duplex printing is performed on the sheet, and when the sheet has a print coverage lower than a threshold value, the controller controls the pair of output rotary bodies to discharge the sheet without holding a trailing end portion of the sheet with the pair of output rotary bodies.

2. An image forming apparatus, comprising:

an output unit to which a sheet having an image formed thereon is discharged;

a pair of output rotary bodies to discharge the sheet to the output unit;

a controller to control the pair of output rotary bodies to feed the sheet, wherein, when plural sheets are sequentially discharged to the output unit, the controller controls overlapping output operation to, with a trailing end portion of a preceding sheet of the plural sheets being held by the pair of output rotary bodies, feed a subsequent sheet of the plural sheets to between the pair of output rotary bodies to overlap a leading end portion of the subsequent sheet with the trailing end portion of the preceding sheet, and with the leading end portion of the subsequent sheet overlapped with the trailing end portion of the preceding sheet, the controller controls the pair of output rotary bodies to rotate to discharge the preceding sheet to the output unit, plural pairs of conveyance rotary bodies; and a sheet detector to detect a trailing end of the sheet, the sheet detector disposed at a position between the pair of output rotary bodies and a pair of conveyance rotary bodies of the plural pairs of conveyance rotary bodies disposed closest to and upstream from the pair of output rotary bodies in a direction in which the sheet is conveyed by the plural pairs of conveyance rotary bodies, wherein the controller controls rotation and stop of the pair of output rotary bodies based on a detection result of the trailing end of the sheet detected by the sheet detector.

* * * * *